US008176607B1

(12) United States Patent
Kubena et al.

(10) Patent No.: US 8,176,607 B1
(45) Date of Patent: May 15, 2012

(54) METHOD OF FABRICATING QUARTZ RESONATORS

(75) Inventors: Randall L. Kubena, Oak Park, CA (US); Tsung-Yuan Hsu, Westlake Village, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 12/575,634

(22) Filed: Oct. 8, 2009

(51) Int. Cl.
*H04R 17/10* (2006.01)
*B21D 53/76* (2006.01)

(52) U.S. Cl. ..... 29/25.35; 29/890.1; 29/852; 310/324; 310/365; 347/70; 347/71

(58) Field of Classification Search ..... 29/890.1, 29/594, 25.35, 846, 852; 310/324, 365, 366; 347/70, 71
See application file for complete search history.

(56) References Cited

U.S. PATENT DOCUMENTS

| | | | | |
|---|---|---|---|---|
| 392,650 | A | 11/1888 | Watrous | |
| 3,766,616 | A | 10/1973 | Staudte | 29/25.35 |
| 4,364,016 | A | 12/1982 | Tanski | 333/193 |
| 4,426,769 | A | 1/1984 | Grabbe | 29/588 |
| 4,442,574 | A | 4/1984 | Wanuga et al. | 29/25.35 |
| 4,618,262 | A | 10/1986 | Maydan et al. | 356/504 |
| 4,870,313 | A | 9/1989 | Hirama et al. | 310/320 |
| 4,898,031 | A | 2/1990 | Oikawa et al. | 73/505 |
| 4,944,836 | A | 7/1990 | Beyer et al. | 438/633 |
| 5,203,208 | A | 4/1993 | Bernstein | 73/505 |
| 5,226,321 | A | 7/1993 | Varnham et al. | 73/505 |
| 5,260,596 | A | 11/1993 | Dunn et al. | 257/414 |
| 5,421,312 | A | 6/1995 | Dawson | 123/620 |
| 5,480,747 | A | 1/1996 | Vasudev | 430/5 |
| 5,552,016 | A | 9/1996 | Ghanayem | 156/345.25 |
| 5,578,976 | A | 11/1996 | Yao et al. | 333/262 |
| 5,589,724 | A | 12/1996 | Satoh et al. | 310/348 |
| 5,604,312 | A | 2/1997 | Lutz | 73/504.14 |

(Continued)

FOREIGN PATENT DOCUMENTS

DE 44 42 033 5/1996

(Continued)

OTHER PUBLICATIONS

Cleland, A.N., et al., "Fabrication of high frequency nanometer scale mechanical resonators from bulk Si crystals," *Appl. Phys. Lett.*, vol. 69, No. 18, pp. 2653-2655, Oct. 28, 1996.

(Continued)

*Primary Examiner* — A. Dexter Tugbang
(74) *Attorney, Agent, or Firm* — Ladas & Parry

(57) ABSTRACT

A method for fabricating VHF and/or UHF quartz resonators (for higher sensitivity) in a cartridges design with the quartz resonators requiring much smaller sample volumes than required by conventional resonators, and also enjoying smaller size and more reliable assembly. MEMS fabrication approaches are used to fabricate with quartz resonators in quartz cavities with electrical interconnects on a top side of a substrate for electrical connection to the electronics preferably through pressure pins in a plastic module. An analyte is exposed to grounded electrodes on a single side of the quartz resonators, thereby preventing electrical coupling of the detector signals through the analyte. The resonators can be mounted on the plastic cartridge or on arrays of plastic cartridges with the use of inert bonding material, die bonding or wafer bonding techniques. This allows the overall size, cost, and required biological sample volume to be reduced while increasing the sensitivity for detecting small mass changes.

22 Claims, 3 Drawing Sheets

U.S. PATENT DOCUMENTS

| | | | | |
|---|---|---|---|---|
| 5,605,490 | A | 2/1997 | Laffey et al. | 451/36 |
| 5,644,139 | A | 7/1997 | Allen | 250/557 |
| 5,646,346 | A | 7/1997 | Okada | 73/504.4 |
| 5,648,849 | A | 7/1997 | Canteloup et al. | 356/503 |
| 5,658,418 | A | 8/1997 | Coronel et al. | 156/345.25 |
| 5,665,915 | A | 9/1997 | Kobayashi et al. | 73/514.32 |
| 5,666,706 | A | 9/1997 | Tomita et al. | 29/25.35 |
| 5,668,057 | A | 9/1997 | Eda et al. | 438/113 |
| 5,728,936 | A | 3/1998 | Lutz | 73/504.15 |
| 5,783,749 | A | 7/1998 | Lee et al. | 73/504.12 |
| 5,894,090 | A | 4/1999 | Tang et al. | 73/504.02 |
| 5,905,202 | A | 5/1999 | Kubena et al. | 73/504.15 |
| 5,920,012 | A | 7/1999 | Pinson | 73/504.13 |
| 5,928,532 | A | 7/1999 | Koshimizu et al. | 219/121.42 |
| 5,942,445 | A | 8/1999 | Kato et al. | 438/691 |
| 5,981,392 | A | 11/1999 | Oishi | 438/691 |
| 5,987,985 | A | 11/1999 | Okada | 73/504.04 |
| 6,009,751 | A | 1/2000 | Ljung | 73/504.02 |
| 6,044,705 | A | 4/2000 | Neukermans et al. | 73/504.02 |
| 6,081,334 | A | 6/2000 | Grimbergen et al. | 356/499 |
| 6,094,985 | A | 8/2000 | Kapels et al. | 73/504 |
| 6,145,380 | A | 11/2000 | MacGugan | 73/493 |
| 6,151,964 | A | 11/2000 | Nakajima | 73/488 |
| 6,155,115 | A | 12/2000 | Ljung | 73/504.12 |
| 6,164,134 | A | 12/2000 | Cargille | 73/504.02 |
| 6,182,352 | B1 | 2/2001 | Deschenes et al. | 29/602.1 |
| 6,196,059 | B1 | 3/2001 | Koesslinger | 73/61.49 |
| 6,207,008 | B1 | 3/2001 | Kijima | 156/345.13 |
| 6,250,157 | B1 | 6/2001 | Touge | 73/504.12 |
| 6,263,552 | B1 | 7/2001 | Takeuchi et al. | 29/25.35 |
| 6,282,958 | B1 | 9/2001 | Fell et al. | 73/504.13 |
| 6,289,733 | B1 | 9/2001 | Challoner et al. | 73/504.12 |
| 6,297,064 | B1 | 10/2001 | Koshimizu | 438/9 |
| 6,349,597 | B1 | 2/2002 | Folkmer et al. | 73/504.08 |
| 6,367,326 | B1 | 4/2002 | Okada | 73/504.13 |
| 6,367,786 | B1 | 4/2002 | Gutierrez et al. | 267/136 |
| 6,413,682 | B1 | 7/2002 | Shibano et al. | 430/5 |
| 6,417,925 | B1 | 7/2002 | Naya | 356/445 |
| 6,424,418 | B2 | 7/2002 | Kawabata et al. | 356/445 |
| 6,426,296 | B1 | 7/2002 | Okojie | 438/692 |
| 6,432,824 | B2 | 8/2002 | Yanagisawa | 438/691 |
| 6,481,284 | B2 | 11/2002 | Geen et al. | 73/504.02 |
| 6,481,285 | B1 | 11/2002 | Shkel et al. | 73/504.13 |
| 6,492,195 | B2 | 12/2002 | Nakanishi | 438/106 |
| 6,513,380 | B2 | 2/2003 | Reeds et al. | 73/504.04 |
| 6,514,767 | B1 | 2/2003 | Natan | 436/166 |
| 6,515,278 | B2 | 2/2003 | Wine et al. | 250/234 |
| 6,584,845 | B1 | 7/2003 | Gutierrez et al. | 73/488 |
| 6,614,529 | B1 | 9/2003 | Tang | 356/630 |
| 6,621,158 | B2 | 9/2003 | Martin et al. | 257/704 |
| 6,627,067 | B1 | 9/2003 | Branton et al. | 205/778 |
| 6,628,177 | B2 | 9/2003 | Clark et al. | 333/196 |
| 6,629,460 | B2 | 10/2003 | Challoner | 73/504.02 |
| 6,651,027 | B2 | 11/2003 | McCall | 702/141 |
| 6,715,352 | B2 | 4/2004 | Tracy | 73/504.02 |
| 6,756,304 | B1 | 6/2004 | Robert | 438/667 |
| 6,796,179 | B2 | 9/2004 | Bae et al. | 73/504.12 |
| 6,806,557 | B2 | 10/2004 | Ding | 257/659 |
| 6,815,228 | B2 | 11/2004 | Usui et al. | 438/14 |
| 6,856,217 | B1 | 2/2005 | Clark et al. | 333/186 |
| 6,883,374 | B2 | 4/2005 | Fell et al. | 73/504.13 |
| 6,933,164 | B2 | 8/2005 | Kubena | 438/49 |
| 6,985,051 | B2 | 1/2006 | Nguyen et al. | 333/186 |
| 7,118,657 | B2 | 10/2006 | Golovchenko et al. | 204/192.3 |
| 7,152,290 | B2 * | 12/2006 | Junhua et al. | 29/25.35 |
| 7,168,318 | B2 | 1/2007 | Challoner et al. | 73/504.13 |
| 7,237,315 | B2 | 7/2007 | Kubena et al. | 29/594 |
| 7,459,099 | B2 | 12/2008 | Kubena et al. | 216/57 |
| 7,543,496 | B2 | 6/2009 | Ayazi | 73/504.02 |
| 7,555,824 | B2 | 7/2009 | Chang | 29/594 |
| 7,559,130 | B2 | 7/2009 | Kubena et al. | 29/594 |
| 7,750,535 | B2 | 7/2010 | Kubena | |
| 7,884,930 | B2 | 2/2011 | Kirby | |
| 2002/0066317 | A1 | 6/2002 | Lin | 73/170.33 |
| 2002/0072246 | A1 | 6/2002 | Goo et al. | 438/758 |
| 2002/0074947 | A1 | 6/2002 | Tsukamoto | 315/169.3 |
| 2002/0107658 | A1 | 8/2002 | McCall | 702/141 |
| 2002/0185611 | A1 | 12/2002 | Menapace et al. | 250/492.1 |
| 2003/0003608 | A1 | 1/2003 | Arikado et al. | 438/14 |
| 2003/0010123 | A1 | 1/2003 | Malvern et al. | 73/514.32 |
| 2003/0029238 | A1 | 2/2003 | Challoner | 73/504.02 |
| 2004/0055380 | A1 | 3/2004 | Shcheglov et al. | 73/504.13 |
| 2004/0065864 | A1 | 4/2004 | Vogt et al. | 252/79.3 |
| 2004/0189311 | A1 | 9/2004 | Glezer | 436/104 |
| 2004/0211052 | A1 | 10/2004 | Kubena et al. | 29/594 |
| 2005/0156309 | A1 | 7/2005 | Fuji | 257/702 |
| 2005/0260792 | A1 | 11/2005 | Patel | 438/107 |
| 2006/0016065 | A1 | 1/2006 | Nagaura | 29/594 |
| 2006/0213266 | A1 | 9/2006 | French | 73/504.02 |
| 2006/0252906 | A1 | 11/2006 | Godschalx et al. | 528/86 |
| 2007/0017287 | A1 | 1/2007 | Kubena | 73/504.02 |
| 2007/0205839 | A1 | 9/2007 | Kubena et al. | 331/158 |
| 2007/0220971 | A1 | 9/2007 | Ayazi | 73/504.02 |
| 2008/0034575 | A1 | 2/2008 | Chang et al. | 29/594 |
| 2008/0074661 | A1 | 3/2008 | Zhang et al. | 356/301 |
| 2008/0096313 | A1 | 4/2008 | Patel | 438/107 |
| 2008/0148846 | A1 | 6/2008 | Whelan | 73/504.02 |
| 2009/0189294 | A1 | 7/2009 | Chang | |
| 2010/0020311 | A1 | 1/2010 | Kirby | |

FOREIGN PATENT DOCUMENTS

| | | | | |
|---|---|---|---|---|
| DE | 19719601 | | 11/1998 | |
| EP | 0 461 761 | | 12/1991 | |
| EP | 0 531 985 | A1 | 3/1993 | |
| EP | 1055908 | | 11/2000 | |
| EP | 0 971 208 | | 12/2000 | |
| JP | 57-091017 | | 6/1982 | |
| JP | 401129517 | | 5/1989 | |
| JP | 04322507 | A | 11/1992 | |
| JP | 05286142 | A * | 11/1993 | 29/890.1 X |
| JP | 08330878 | A | 12/1996 | |
| JP | 2005-180921 | A | 7/2005 | |
| KR | 10-2001-0110428 | A | 12/2001 | |
| WO | 96/38710 | | 12/1996 | |
| WO | 98/15799 | | 4/1998 | |
| WO | 00/68640 | | 11/2000 | |
| WO | 01/44823 | | 6/2001 | |
| WO | 01/74708 | | 10/2001 | |
| WO | 02/12873 | | 2/2002 | |
| WO | 2005/121769 | | 12/2005 | |
| WO | 2006/010206 | | 2/2006 | |
| WO | 2006/103439 | | 10/2006 | |
| WO | 2006/103439 | A2 | 10/2006 | |

OTHER PUBLICATIONS

Evoy, S., et al., "Temperature-dependent internal friction in silicon nanoelectromechanical systems," *Applied Physics Letters*, vol. 77, No. 15, pp. 2397-2399, Oct. 9, 2000.

Greer, J.A., et al., "Properties of SAW resonators fabricated on quartz substractes of various qualities," Ultrasonics Symposium, Proceedings, 1994 IEEE, vol. 1, 1-4, pp. 31-36, Nov. 1994.

Sirbuly, Donald J., et al., "Multifunctional Nanowire Evanescent Wave Optical Sensors," Advanced Materials, 19, pp. 61-66, 2007 (published online: Dec. 5, 2006).

White, Lan M., et al., "Increasing the Enhancement of SERS with Dielectric Microsphere Resonators," Spectroscopy-Eugene, Apr. 2006.

Yan, Fei, et al., "Surface-enhanced Raman scattering (SERS) detection for chemical and biological agents," IEEE Sensors Journal, vol. 5, No. 4, Aug. 2005.

Evoy, S., et al., "Temperature-dependent internal friction in silicon nanoelectromechanical systems," Applied Physics Letters, vol. 77, No. 15, pp. 2397-2399 (Oct. 9, 2000).

Wright et al., "The HRG Applied to a Satellite Attitude Reference System," Guidance and Control, AASAAS, 1994, 86:55-67.

Putty et al., "A Micromachined Vibrating Ring Gyroscope,", Solid State Sensor and Actuator Workshop, Transducer Research Foundation, Hilton Head, 1994, pp. 213-220.

Tang et al., "A Packaged Silicon MEMS Vibratory Gyroscope for Microspacecraft," Proceedings IEEE, 10th Annual Int. Workshop on MEMS, Japan, 1997, pp. 500-505.

Barbour et al., "Micromechanical Silicon Instrument and Systems Development at Draper Laboratory," AIAA Guidance Navigation and Control Conference, 1996, Paper No. 96-3709.

Johnson et al., "Surface Micromachined Angular Rate Sensor," A1995 SAE Conference, Paper No. 950538, pp. 77-83.
Fujita et al., "Disk-shaped bulk micromachined gyroscope with vacuum sealing," Sensors and Actuators A:Physical, vol. 82, May 2000, pp. 198-204.
Skulski et al., "Planar resonator sensor for moisture measurements", Microwaves and Radar, 1998, MIKON '98, 12th International Conf., vol. 3, May 20-22, 1998, pp. 692-695.
Tang et al., "Silicon Bulk Micromachined Vibratory Gyroscope," Jet Propulsion Lab.
Sirbuly, Donald J. et al., "Multifunctional Nanowire Evanescent Wave Optical Sensors," Advanced Materials, 2007 (published online: Dec. 5, 2006), 19, pp. 61-66.

White, Lan M., et al., Increasing the Enhancement of SERS with Dielectric Microsphere Resonators, Spectroscopy-Eugene, Apr. 2006.

* cited by examiner

METHOD OF FABRICATING QUARTZ RESONATORS

CROSS REFERENCE TO RELATED APPLICATIONS

Published PCT Application WO 2006/103439 entitled "Cartridge for a Fluid Sample Analyzer" and U.S. Pat. No. 7,237,315, entitled "Method for Fabricating a Resonator" are hereby incorporated herein by this reference.

TECHNICAL FIELD

This application relates to high frequency quartz-based resonators, which may be used in biological analysis applications at high frequencies such as VHF and/or UHF frequencies, and methods of making same.

BACKGROUND

Small biological detectors using quartz mass sensing currently are commercially implemented using low frequency (~10 MHz) quartz resonators on macro-size substrates mounted on plastic disposable cartridges for biological sample exposure and electrical activation.

Previous quartz resonators used in biological analysis have utilized flat quartz substrates with electrodes deposited on opposite sides of the quartz for shear mode operation in liquids. In order for the substrates not to break during fabrication and assembly, the quartz substrate needs to be of the order of 100 microns thick. This sets a frequency limit for the resonator of roughly ~20 MHz since the frequency is inversely proportional to the thickness.

Chemically etching inverted mesas has been used to produce higher frequency resonators, but this usually produces etch pits in the quartz that can result in a porous resonator which is not suitable for liquid isolation.

However, it is well known that the relative frequency shift for quartz sensors for a given increase in the mass per unit area is proportional to the resonant frequency as given by the Sauerbrey equation. Therefore, it is desirable to operate the sensor at a high frequency (UHF) and thus use ultra-thin substrates that have not been chemically etched.

It is also desirable to minimize the diffusion path length in the analyte solution to the sensor surface to minimize the reaction time needed to acquire a given increase in the mass per unit area. Thus, the dimension of the flow cell around the sensor in the direction perpendicular to the sensor should be minimized. Currently, this dimension is determined by the physical thickness of adhesive tape (WO 2006/103439 A2) and is of the order of 85 microns. It is desirable not to increase this dimension when implementing a higher frequency resonator. In addition, the alignment of tape and the quartz resonators can be difficult and unreliable thereby causing operational variations.

Current UHF quartz MEMS resonators fabricated for integration with electronics (see U.S. Pat. No. 7,237,315) can not be used in commercial low cost sensor cartridges since one metal electrode can not be isolated in a liquid from the other electrode and electrical connections can not be made outside the liquid environment.

Commercial quartz resonators are formed by lapping and polishing small 1-2 inch quartz substrates to approximately the proper frequency and then chemically etching away the unwanted quartz between the resonators. Chemical etching is also used to fine tune the frequencies and to etch inverted mesas for higher frequency operation. However, as stated above, handling and cracking issues usually dictate that the lapped and polished thicknesses are of the order of 100 microns, and chemically etching deep inverted mesas produces etch pits which significantly reduce the yield and can result in a porous resonator. This invention suggests utilizing the previously disclosed (see U.S. Pat. No. 7,237,315 mentioned above) handle wafer technology for handling large thin quartz substrates for high frequency operation plus double inverted mesa technology using dry etching for providing high frequency non-porous resonators with (1) a thick frame for minimizing mounting stress changes in the resonator frequencies once a flow cell is formed, (2) a thin flow cell for reducing the sensor reaction time, and (3) quartz through wafer vias for isolating the active electrodes and electrical interconnects from the flow cell. Since, to the inventor's understanding, commercial manufacturers do not use quartz plasma etching for defining thin non-porous membranes nor quartz through-wafer vias for conventional packaging, the current fabrication and structure would not be obvious to one skilled in the art familiar with this conventional technology.

There is a need for even smaller biological detectors, which can effectively work with even smaller sample volumes yet having even greater sensitivity than prior art detectors.

BRIEF DESCRIPTION OF THE INVENTION

In general, this invention relates to a method for fabricating higher frequency quartz resonators (for higher sensitivity) in these cartridges requiring much smaller sample volumes, smaller size, and more reliable assembly and to the quartz resonators themselves. The presently described method preferably uses MEMS fabrication approaches to fabricate high frequency quartz resonators in quartz cavities with electrical interconnects on a top side of the substrate for electrical connection to the electronics preferably through pressure pins in a plastic module. The analyte is preferably exposed to grounded electrodes on a single side of the quartz resonators, thereby preventing electrical coupling of the detector signals through the biological solutions. The resonators are preferably mounted on the plastic cartridge with the use of inert bonding material and die bonding. This allows the overall size, cost, and required biological sample volume to be reduced while increasing the sensitivity for detecting small mass changes.

In one aspect, the present invention provides a method of fabricating quartz resonators comprising forming an array of metal electrodes, pads, and interconnects on a first side of a piezoelectric quartz wafer; bonding the quartz substrate to one or more handle wafers; etching vias in the piezoelectric quartz wafer; and forming an array of metal electrodes on a second side of the piezoelectric quartz wafer. An array of metal plugs is formed in said vias for connecting the electrodes on said second side of said piezoelectric quartz wafer to the pads on said first side of said piezoelectric quartz wafer. An array of metal electrodes and interconnects are formed on the second side of the piezoelectric quartz wafer. The piezoelectric quartz wafer is diced and separated along dicing lines formed therein to thereby define a plurality of dies, each die having at least one metal electrode formed on the first side of the piezoelectric quartz wafer thereof and at least one opposing metal electrode formed on the second side of the piezoelectric quartz wafer thereof. The dies are adhered to a substrate with fluid ports therein, the fluid ports being aligned to the metal electrodes of the die, thereby forming at least one flow cell in each die with the at least one metal electrode formed on the first side of the piezoelectric quartz wafer in said at least one flow cell and at least one opposing metal electrode formed on the second side of the piezoelectric quartz wafer of said dies opposite said at least one flow cell. The one or more handle wafers is removed, thereby exposing the pads on the first side of the dies, said pads, in use, providing a circuit connection allowing for electrical excitation of the metal electrodes of the resonators.

In another aspect, the present invention provides a method of fabricating a quartz resonator comprising: forming a metal electrode, pads, and interconnects on a first side of a piezoelectric quartz wafer; bonding the quartz substrate to a handle wafers; etching at least one via in the piezoelectric quartz wafer; and forming metal an electrode on a second side of the piezoelectric quartz wafer, the electrode on the second side of the piezoelectric quartz wafer directly opposing the electrode on the first side of the piezoelectric quartz wafer. At least one metal plug is formed in said at least one via and connecting the electrode on said second side of said piezoelectric quartz wafer to one of the pads on said first side of said piezoelectric quartz wafer and the piezoelectric quartz wafer is attached or adhered to a substrate with fluid ports therein, the fluid ports being aligned to the metal electrode on the second side of the piezoelectric quartz wafer, thereby forming a flow cell in the quartz resonator with the metal electrode formed on the first side of the piezoelectric quartz wafer being disposed in said flow cell and the metal electrode formed on the second side of the piezoelectric quartz wafer being disposed opposite said flow cell. The handle wafer is removed, thereby exposing the pads on the second side of the piezoelectric quartz wafer, said pads, in use, providing circuit connection points for allowing electrical excitation of the metal electrodes of the resonator.

In still yet another aspect the present invention provides a quart resonator including a piezoelectric quartz wafer having an electrode, pads, and interconnects disposed on a first side thereof, having a second electrode disposed on a second side thereof, the second electrode being disposed opposing the first mentioned electrode, and having at least one penetration for coupling the electrode on said second side of said piezoelectric quartz wafer to one of the pads on said first side of said piezoelectric quartz wafer; and a substrate with fluid ports provided therein, the piezoelectric quartz wafer being mounted to the substrate such the second side thereof faces the substrate with a cavity being defined between the substrate and the wafer and such that the fluid ports in the substrate are aligned with the electrode on the second side of the piezoelectric quartz wafer, thereby forming a flow cell in the cavity with the electrode disposed on the second side of the piezoelectric quartz wafer being in contact with said flow cell and the electrode formed on the first side of the piezoelectric quartz wafer being disposed on said wafer opposite said flow cell.

DETAILED DESCRIPTION

Figure 1A:
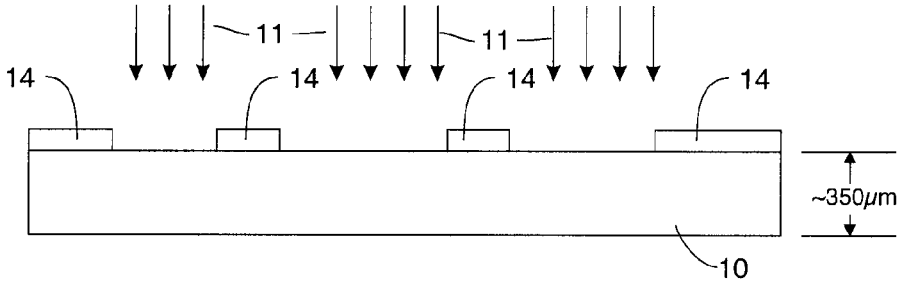
FIGS. 1(*a*)-1(*l*) depict, in a series of side elevational views, steps which may be used to make the sensor described herein and also serve to show its internal construction details.
Figure 1B:
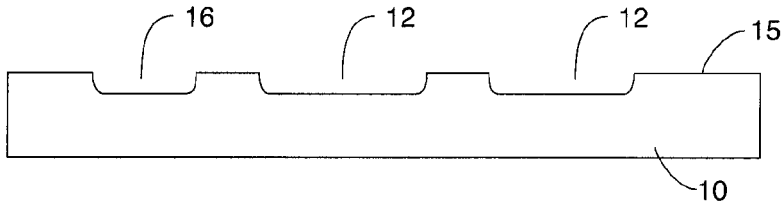
Figure 1C:
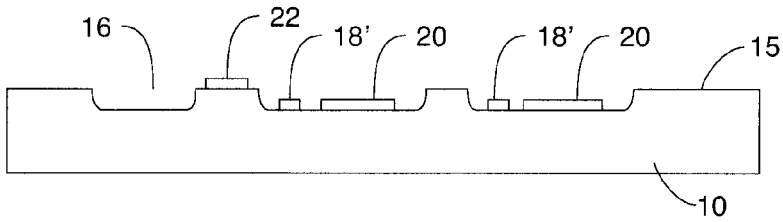
Figure 1D:
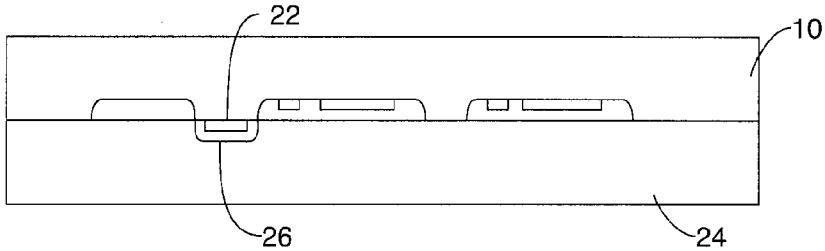
Figure 1E:
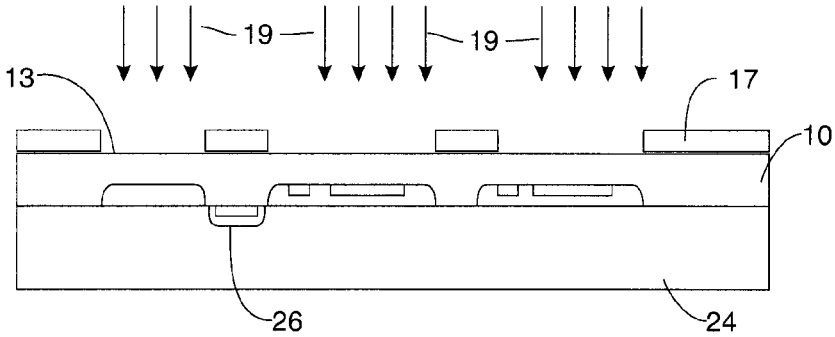
Figure 1F:
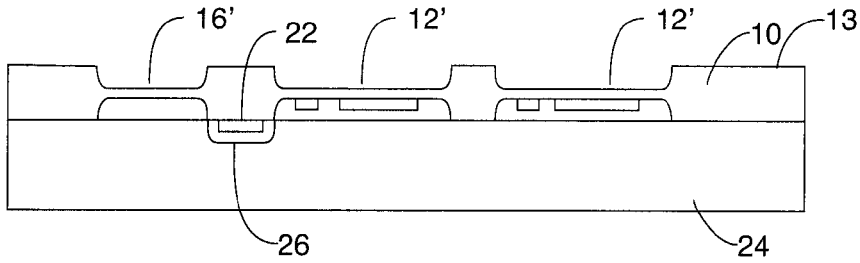
Figure 1G:
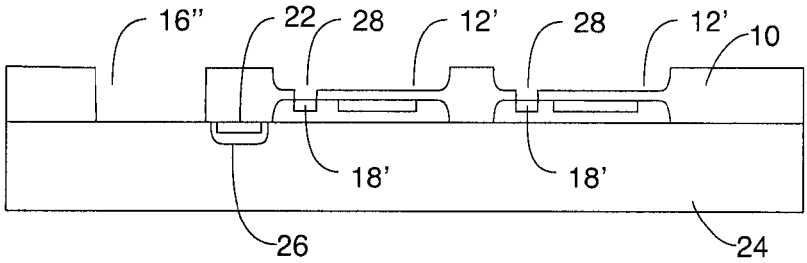
Figure 1H:
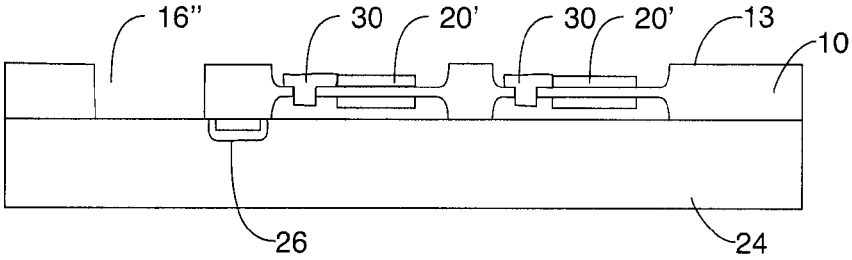
Figure 1I:
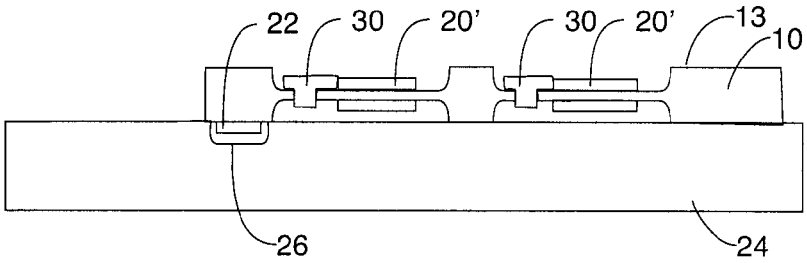
Figure 1J:
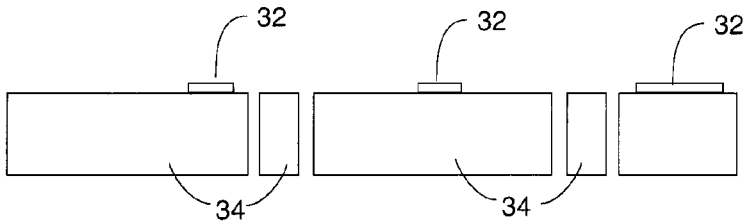
Figure 1K:
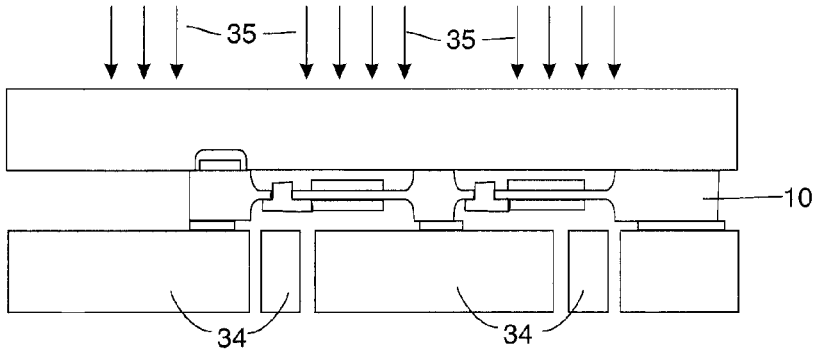
Figure 1L:
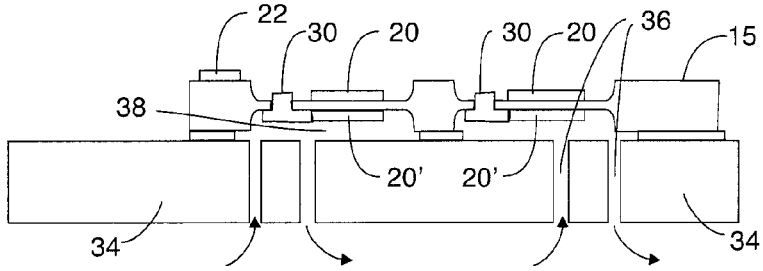

FIGS. 1(*a*)-1(*l*) depict, in a series of side elevational views, steps which may be used to make the sensor described herein. These elevation views are taken along a section line 1-1 depicted in FIG. 2.

The formation of the disclosed sensor starts with a piezoelectric quartz wafer 10 preferably 3"~4" in diameter, AT-cut, with a thickness of preferably about 350 microns. As shown in FIG. 1(*a*), a mask 14 in combination with a dry plasma etch 11 (to prevent the formation of etch pits), are preferably used to form inverted mesas 12 (see FIG. 1(*b*)) etched in a top or first surface of wafer 10. Mask 14 is preferably formed of a thick resist or metal such as Ni or Al. In this connection, a solid layer of Ni or Al is may be put down and then a conventional photo-mask may be used to etch the Ni or Al in order to make mask 14 out of that metal. The preferred approach is to electroplate Ni onto a resist mold to form mask 14. This dry plasma etch 11 through mask 14 is optional, but is preferred, and it preferably etches about 10 to 20 microns deep into the piezoelectric quartz wafer 10 through the openings in mask 14 thereby forming inverted mesas 12 and preferably one or more additional regions 16. Regions 16 are also preferably etched at the same time for eventually cleaving or separating the quartz 10 into a plurality of sensors made on a common quartz wafer 10 along dicing lanes.

Next, the mask 14 is stripped away and interconnect metal 18, preferably comprising Cr/Ni/Au, is formed for use in help forming vias (which will be more fully formed later wherein a portion of the interconnect metal acts an as etch stop 18'). Additionally, top side (or first side) electrodes 20 are formed at the same time preferably comprising Cr/Ni/Au. Metal pads $\mathbf{22}_1$-$\mathbf{22}_3$ are also formed, preferably of Cr/Au, for cartridge pins. The interconnect metal 18 (including etch stops 18'), electrodes 20 and pads $\mathbf{22}_1$-$\mathbf{22}_3$ are formed as shown in FIGS. 1(*c*) and 2. A spray resist may be utilized to define the pattern of the metalization for interconnect metal 18 and top side electrodes 20 in the inverted mesas 12 and the metalization for pads 22 on unetched surfaces of quartz wafer 10. The pads $\mathbf{22}_1$-$\mathbf{22}_3$ are collectively numbered 22 in FIG. 1(*d*).

The interconnect metal 18 preferably interconnects pad $\mathbf{22}_3$ and the top side electrode 20 and preferably interconnects pads $\mathbf{22}_1$ and $\mathbf{22}_2$ and with metal plugs 30 to be formed in the yet to be formed vias 28. See FIG. 2.

Turning now to FIG. 1(*d*), the top or first side 15 of the quartz wafer 10 is then bonded, preferably at a low temperature (for example, less than _____° C.), to a Si handle wafer 24 shown in FIG. 1(*d*) for further thinning and polishing of the quartz wafer 10 using lapping, grinding, and/or chemical mechanical polishing (CMP), for example. Handle wafer 24 preferably has one or more inverted mesas 26 for receiving the topside pads $\mathbf{22}_1$-$\mathbf{22}_3$ disposed on the unetched top or first surface 15 of wafer 10. The quartz wafer 10 is then preferably thinned to about 2-50 microns depending on final design requirements. The quartz wafer 10 typically starts out being thicker, since it is commercially available in thicknesses greater than needed, and therefor quartz wafer 10 typically should be thinned to a desired thickness, preferably in the range of 10 to 50 microns.

Next the inverted quartz wafer 10 is plasma etched again, preferably using the same Ni or Al metal mask and photoresist masking technique as described above, with a mask 17 and a dry etch 19 (see FIG. 1(*e*)) to form inverted mesas 12' and dicing lanes 16' in the bottom side or second surface 13 of the quartz wafer 10, the inverted mesas 12' and dicing lanes 16' being preferably aligned with the top side inverted mesas 12 and dicing lanes 16 respectively, as shown in FIG. 1(*f*). In combination with bonding adhesive or tape 32 (see FIG. 1(*j*)) thickness used on a cartridge 34, the bottom etch depth defines a vertical dimension of a yet-to-be-formed flow cell 38 (see FIG. 1(*l*)).

Turning now to FIG. 1(*g*), vias 28 are then etched against etch stops 18', preferably using a dry etch, in the depicted structure and dicing lanes 16" are preferably etched through by joining the previously etched regions 16 and 16'. The etching of vias 28 stop against the Ni layer in etch stop layer 18' in the top-side interconnect metalization 18 as shown in FIG. 1(*g*). As previously mentioned, the etch stop layer 18' is preferably Cr/Ni/Au, so the Cr layer thereof is etched through and the dry etching stops at the Ni layer thereof. This etch stop layer 18' is preferably formed by the interconnect metal 18. The vias 28 are then coated with preferably a metal using a thick resist process to electrically connect to interconnect 18 exposed in the vias 28 to form plugs 30. A coated metal, such as a sputter layer, for example, is used to cover the exposed interconnect in the via opening 28 with a conformal metal layer 30 such as a sputtered Au layer for connecting the bottom electrodes 20' to top-side interconnects 18 and to pin pad $\mathbf{22}_3$. Finally, bottom electrode metal 20' is deposited as shown in FIG. 1(*h*). The final resonator quartz thickness is preferably about 2-10 microns measured between the metal electrodes 20, 20' while the quartz frame surrounding the inverted mesas 12, 12' is perhaps 30-50 microns in thickness. However, a simplified process is envisioned in which one of both inverted mesa etches are omitted (so inverted mesas 12, 12' are formed on only one side of the quartz wafer 10 or on neither side thereof), in which case the quartz wafer 10 is left planar or quasi-planar with a thinned thickness of about 10 microns.

The completed wafer 10 is then diced along dicing lines 16" to yield individual dies of two or more resonators mounted on a Si handle wafer 24 as shown in FIG. 1(*i*). The final assembly to a plastic cartridge 34 (a bottom portion of which is depicted in FIG. 1(*j*)) is accomplished (see FIG. 1(*k*)) using die bonding to an adhesive 32 located on the cartridge 34. This adhesive 32 can be, for example, in the form of a kapton polyimide tape with a silicone (for example) adhesive layer or a seal ring of epoxy applied with an appropriate dispensing system. Other adhesives may be used if desired or preferred. Once bonded to the cartridge 34, the resonators are released preferably using a dry etch 35 such as $SF_6$ plasma etching and/or $XeF_2$ to remove the Si handle wafer 24 as shown in FIGS. 1(*k*) and 1(*l*). Of course, this etching step should not significantly etch the adhesive 32. A top section of the cartridge 34, such as the cartridge described in published PCT Application WO 2006/103439 A2, can then be aligned and adhered to the bottom portion for use as shown by FIG. 1(*l*). Openings 36 in the cartridge 34 allow a fluid (depicted by the arrows) to enter and exit a chamber 38 defined by the walls of the inverted mesas. Alternatively, the dicing may be accomplished after attachment of the cartridge whereby the cartridges could be formed as an array mounted on a thin plastic sheet and brought into contact with a plurality of dies all at the same time.

Figure 2:
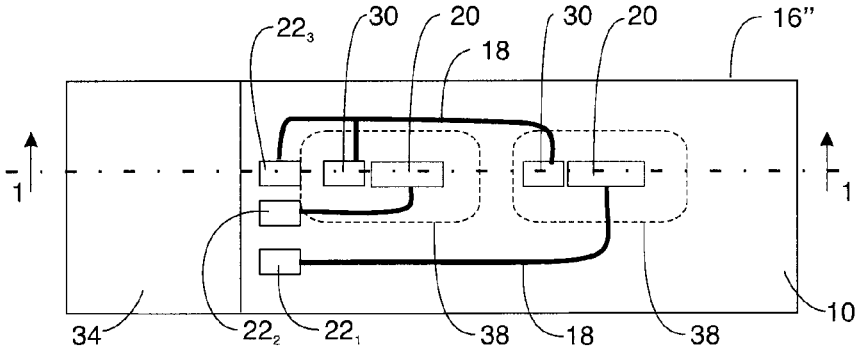
FIG. 2 is a top view of the sensor described herein.

The resonators are electrically excited by signals applied on the top pads as shown in the top-view drawing in FIG. 2. An analyte flows through the resonator along the flow paths shown by the arrows in FIG. 1(*l*) into and out of chambers 38 defined in the resonators. The pad $\mathbf{22}_3$ is preferably connected to a ground associated with the resonator detector signal. Pads $\mathbf{22}_1$ and $\mathbf{22}_2$ are connected to the electrodes 20 on the first side of the piezoelectric wafer 10. In this way the electrode 20' on the second side of the piezoelectric quartz wafer is grounded and the analyte in chamber 38 is exposed to the grounded electrode 20' on the second side of the piezoelectric quartz wafer 10, thereby preventing electrical coupling of detector signals obtained at pads $\mathbf{22}_1$ and $\mathbf{22}_2$ from the electrodes 20 on the first side of the piezoelectric quartz wafer 10 to the analyte in chamber 38.

The dimensions of the chambers 38 are preferably on the order of 400×400 μm square and 40 μm deep, yielding a sample volume of approximately $6.4\times10^{-6}$ cc (6.4 nL).

In broad overview, this description has disclosed a method for fabricating VHF and/or UHF quartz resonators (for higher sensitivity) in a cartridges design with the quartz resonators requiring much smaller sample volumes than required by conventional resonators, and also enjoying smaller size and more reliable assembly. MEMS fabrication approaches are used to fabricate with quartz resonators in quartz cavities with electrical interconnects on a top side of a substrate for electrical connection to the electronics preferably through pressure pins in a plastic module. An analyte is exposed to grounded electrodes on a single side of the quartz resonators, thereby preventing electrical coupling of the detector signals through the analyte. The resonators can be mounted on the plastic cartridge or on arrays of plastic cartridges with the use of inert bonding material, die bonding or wafer bonding techniques. This allows the overall size, cost, and required biological sample volume to be reduced while increasing the sensitivity for detecting small mass changes.

At least the following concepts have been presented by the present description.

Concept 1. A method of fabricating quartz resonators comprising:

forming electrodes, pads, and interconnects on a first side of a piezoelectric quartz wafer;

bonding the quartz substrate to one or more handle wafers;

etching vias in the piezoelectric quartz wafer;

forming electrodes and interconnects on a second side of the piezoelectric quartz wafer;

forming metal plugs in said vias to connect the electrodes on said second side of said piezoelectric quartz wafer to the pads on said first side of said piezoelectric quartz wafer;

dicing the piezoelectric quartz wafer along dicing lines formed therein to thereby define a plurality of dies, each die having at least one metal electrode formed on the first side of the piezoelectric quartz wafer thereof and at least one opposing metal electrode formed on the second side of the piezoelectric quartz wafer thereof;

adhering the dies to a substrate with fluid ports therein, the fluid ports being associated with the electrodes of the die, thereby forming at least one flow cell in each die with the at least one electrode formed on the first side of the piezoelectric quartz wafer in said at least one flow cell and at least one opposing electrode formed on the second side of the piezoelectric quartz wafer of said at least one die opposite said at least one flow cell; and removing the one or more handle wafers, thereby exposing the pads on the first side of the dies, said pads, in use, providing circuit connection points for allowing electrical excitation of the electrodes.

Concept 2. The method of fabricating quartz resonators according to concept 1 further comprising etching inverted mesas in the first side of the piezoelectric quartz wafer wherein the electrodes formed on said first side are disposed within one or more of said inverted mesas.

Concept 3. The method of fabricating quartz resonators according to concept 2 further comprising etching inverted mesas in the second side of the piezoelectric quartz wafer wherein the electrodes formed on said second side of the piezoelectric quartz wafer are disposed within one or more of said inverted mesas formed on said second side of the piezoelectric quartz wafer.

Concept 4. The method of fabricating quartz resonators according to concept 3 in which the inverted mesas are etched with a plasma etch.

Concept 5. The method of fabricating quartz resonators according to concept 1 further comprising etching inverted mesas in the second side of the piezoelectric quartz wafer wherein the electrodes formed on said second side of the piezoelectric quartz wafer are disposed within one or more of said inverted mesas formed on said second side of the piezoelectric quartz wafer.

Concept 6. The method of fabricating quartz resonators according to concept 5 in which the inverted mesas are etched with a plasma etch.

Concept 7. The method of fabricating quartz resonators according to concept 1 further comprising thinning the piezoelectric quartz wafer to 2-50 microns in an active resonator region between the electrodes formed on said first and second sides of the piezoelectric quartz wafer.

Concept 8. The method of fabricating quartz resonators according to concept 1 wherein the dies are adhered to said substrate with fluid ports therein using an inert polyimide-based tape or an epoxy adhesive.

Concept 9. The method of fabricating quartz resonators according to concept 1 wherein the one or more handle wafers is removed with a fluorine-based plasma etch and/or $XeF_2$.

Concept 10. A method of analyzing an analyte using a quartz resonator made in accordance with concept 1 wherein the electrode on the second side of the piezoelectric quartz wafer is grounded and the analyte is exposed to the grounded electrode on the second side of the piezoelectric quartz wafer, thereby preventing electrical coupling of detector signals, obtained from the electrode on the first side of the piezoelectric quartz wafer, to the analyte.

Concept 11. A method of fabricating a quartz resonator comprising:

forming electrode, pads, and interconnects on a first side of a piezoelectric quartz wafer;

bonding the quartz substrate to a handle wafer;

forming at least one via in the piezoelectric quartz wafer;

forming an electrode on a second side of the piezoelectric quartz wafer, the electrode on the second side of the piezoelectric quartz wafer directly opposing the electrode on the first side of the piezoelectric quartz wafer;

forming at least one metal plug in said at least one via and connecting the electrode on said second side of said piezoelectric quartz wafer to one of the pads on said first side of said piezoelectric quartz wafer;

adhering said piezoelectric quartz wafer to a substrate with fluid ports therein, the fluid ports being aligned to the electrode on the second side of the piezoelectric quartz wafer, thereby forming a flow cell in the quartz resonator with the electrode formed on the second side of the piezoelectric quartz wafer being disposed in said flow cell and the electrode formed on the first side of the piezoelectric quartz wafer being disposed opposite said flow cell; and removing the handle wafer, thereby exposing the pads on the first side of the piezoelectric quartz wafer, said pads, in use, providing circuit connection points for allowing electrical excitation of the electrodes.

Concept 12. The method of fabricating a quartz resonator according to concept 11 further comprising etching one or more inverted mesas in the first side of the piezoelectric quartz wafer wherein the metal electrode formed on said first side is disposed within one of said one or more inverted mesas.

Concept 13. The method of fabricating a quartz resonator according to concept 12 further comprising etching one or more inverted mesas in the second side of the piezoelectric quartz wafer wherein the metal electrode formed on said second side of the piezoelectric quartz wafer is disposed within one of said one or more inverted mesas formed on said second side of the piezoelectric quartz wafer.

Concept 14. The method of fabricating a quartz resonator according to concept 13 wherein a plurality of electrodes are formed in a plurality of inverted mesas formed in the first side of the piezoelectric quartz wafer and a plurality of electrodes are formed in a plurality of inverted mesas formed in the second side of the piezoelectric quartz wafer, the inverted mesas in the first side of the piezoelectric quartz wafer opposing corresponding inverted mesas in the second side of the piezoelectric quartz wafer and the electrodes formed in inverted mesas in the first side of the piezoelectric quartz wafer opposing corresponding electrodes formed in inverted mesas in the second side of the piezoelectric quartz wafer.

Concept 15. The method of fabricating a quartz resonator according to concept 11 further comprising etching one or more inverted mesas in the second side of the piezoelectric quartz wafer wherein the metal electrode formed on said second side of the piezoelectric quartz wafer is disposed within one of said one or more inverted mesas formed on said second side of the piezoelectric quartz wafer.

Concept 16. The method of fabricating a quartz resonator according to concept 15 in which the inverted mesas are etched with a plasma etch.

Concept 17. The method of fabricating quartz resonators according to concept 11 further comprising thinning the piezoelectric quartz wafer to 2-50 microns in an active resonator region between opposing electrodes formed on said first and second sides of the piezoelectric quartz wafer.

Concept 18. The method of fabricating quartz resonators according to concept 11 wherein the piezoelectric quartz wafer is adhered to said substrate with fluid ports therein using an inert polyimide-based tape or an epoxy adhesive.

Concept 19. The method of fabricating quartz resonators according to concept 11 wherein the one or more handle wafers is removed with a fluorine-based plasma etch and/or $XeF_2$.

Concept 20. A method of analyzing an analyte using a quartz resonator made in according with concept 11 wherein the electrode on the second side of the piezoelectric quartz wafer is grounded and the analyte is exposed to the grounded electrodes on the second side of the piezoelectric quartz wafer, thereby preventing electrical coupling of detector signals, obtained from the electrode on the first side of the piezoelectric quartz wafer, to the analyte.

Concept 21. A quart resonator for comprising:

a piezoelectric quartz wafer with an electrode, pads, and interconnects disposed on a first side thereof, piezoelectric quartz wafer having a second electrode disposed on a second side thereof, the second electrode opposing the first mentioned electrode, the electrode on said second side of said piezoelectric quartz wafer being connected to one of the pads on said first side of said piezoelectric quartz wafer; and a substrate having fluid ports therein, the piezoelectric quartz wafer being mounted to the substrate such the second side thereof faces the substrate with a cavity being defined between the substrate and the wafer and such that the fluid ports in the substrate are aligned with the electrode on the second side of the piezoelectric quartz wafer, thereby forming a flow cell in the cavity with the electrode disposed on the second side of the piezoelectric quartz wafer being in contact with said flow cell and the electrode formed on the first side of the piezoelectric quartz wafer being disposed on the first side of said wafer and opposite to said flow cell.

Concept 22. The quart resonator of concept 21 wherein the wafer has at least one inverted mesa defined therein for forming at least a portion of said cavity.

Concept 23. The quart resonator of concept 21 wherein the wafer as a penetration for connecting the electrode on said second side of said piezoelectric quartz wafer to one of the pads on said first side thereof.

Concept 24. The quart resonator of concept 21 wherein an analyte is in said cavity and wherein the electrode on the second side of the piezoelectric quartz wafer is grounded and detector signals are coupled to the electrode on the first side of the wafer so that the analyte is exposed to the grounded electrode on the second side of the piezoelectric quartz wafer, thereby preventing electrical coupling of detector signals, from the electrode on the first side of the piezoelectric quartz wafer, to the analyte.

Having described the invention in connection with certain embodiments thereof, modification will now suggest itself to those skilled in the art. As such, the invention is not to be limited to the disclosed embodiment except as is specifically required by the appended claims.

What is claimed is:

1. A method of fabricating quartz resonators comprising:

forming electrodes, pads, and interconnects on a first side of a piezoelectric quartz wafer;

bonding the piezoelectric quartz wafer to one or more handle wafers;

etching vias in the piezoelectric quartz wafer;

forming electrodes and interconnects on a second side of the piezoelectric quartz wafer;

forming metal plugs in said vias to connect the electrodes on said second side of said piezoelectric quartz wafer to the pads on said first side of said piezoelectric quartz wafer;

dicing the piezoelectric quartz wafer along dicing lines formed therein to thereby define a plurality of dies, each die having at least one metal electrode formed on the first side of the piezoelectric quartz wafer thereof and at least one opposing metal electrode formed on the second side of the piezoelectric quartz wafer thereof;

adhering the dies to a substrate with fluid ports therein, the fluid ports being associated with the metal electrodes formed on the first side of the die, thereby forming at least one fluid flow cell in each die with the at least one metal electrode formed on the first side of the piezoelectric quartz wafer in said at least one fluid flow cell and at least one opposing metal electrode formed on the second side of the piezoelectric quartz wafer of said at least one die opposite said at least one fluid flow cell; and removing the one or more handle wafers, thereby exposing the pads on the first side of the dies, said pads on the first side of the dies, in use, providing circuit connection points for allowing electrical excitation of the metal electrodes on the first side of the dies and the opposing metal electrodes on the second side of the dies.

2. The method of fabricating quartz resonators according to claim 1 further comprising etching inverted mesas in the first side of the piezoelectric quartz wafer wherein the electrodes formed on said first side are disposed within one or more of said inverted mesas.

3. The method of fabricating quartz resonators according to claim 2 further comprising etching inverted mesas in the second side of the piezoelectric quartz wafer wherein the electrodes formed on said second side of the piezoelectric quartz wafer are disposed within one or more of said inverted mesas formed on said second side of the piezoelectric quartz wafer.

4. The method of fabricating quartz resonators according to claim 3 in which the inverted mesas are etched with a plasma etch.

5. The method of fabricating quartz resonators according to claim 1 further comprising etching inverted mesas in the second side of the piezoelectric quartz wafer wherein the electrodes formed on said second side of the piezoelectric quartz wafer are disposed within one or more of said inverted mesas formed on said second side of the piezoelectric quartz wafer.

6. The method of fabricating quartz resonators according to claim 5 in which the inverted mesas are etched with a plasma etch.

7. The method of fabricating quartz resonators according to claim 1 further comprising thinning the piezoelectric quartz wafer to 2-50 microns in an active resonator region between the electrodes formed on said first and second sides of the piezoelectric quartz wafer.

8. The method of fabricating quartz resonators according to claim 1 wherein the dies are adhered to said substrate with the fluid ports therein using an inert polyimide-based tape or an epoxy adhesive.

9. The method of fabricating quartz resonators according to claim 1 wherein the one or more handle wafers is removed with a fluorine-based plasma etch and/or $XeF_2$.

10. A method of analyzing an analyte using a quartz resonator made in accordance with claim 1 wherein the electrode on the second side of the piezoelectric quartz wafer is grounded and the analyte is exposed to the grounded electrode on the second side of the piezoelectric quartz wafer, thereby preventing electrical coupling of detector signals, obtained from the electrode on the first side of the piezoelectric quartz wafer, to the analyte.

11. The method of fabricating quartz resonators comprising according to claim 1 wherein electrodes formed on the second side of the piezoelectric quartz wafer directly oppose electrodes formed on the first side of the piezoelectric quartz wafer.

12. A method of fabricating a quartz resonator comprising:

forming electrode, pads, and interconnects on a first side of a piezoelectric quartz wafer;

bonding the piezoelectric quartz wafer to a handle wafer;

forming at least one via in the piezoelectric quartz wafer;

forming an electrode on a second side of the piezoelectric quartz wafer;

forming at least one metal plug in said at least one via and connecting the electrode on said second side of said piezoelectric quartz wafer to one of the pads on said first side of said piezoelectric quartz wafer;

adhering said piezoelectric quartz wafer to a substrate with fluid ports therein, the fluid ports being aligned to the electrode on the second side of the piezoelectric quartz wafer, thereby forming a flow cell in the quartz resonator with the electrode formed on the second side of the piezoelectric quartz wafer being disposed in said flow cell and the electrode formed on the first side of the piezoelectric quartz wafer being disposed opposite said flow cell; and removing the handle wafer, thereby exposing the pads on the first side of the piezoelectric quartz wafer, said pads on the first side of the piezoelectric quartz wafer, in use, providing circuit connection points for allowing electrical excitation of the electrodes on the first and second sides of the piezoelectric quartz wafer.

13. The method of fabricating a quartz resonator according to claim 12 further comprising etching one or more inverted mesas in the first side of the piezoelectric quartz wafer wherein the metal electrode formed on said first side is disposed within one of said one or more inverted mesas.

14. The method of fabricating a quartz resonator according to claim 13 further comprising etching one or more inverted mesas in the second side of the piezoelectric quartz wafer wherein the metal electrode formed on said second side of the piezoelectric quartz wafer is disposed within one of said one or more inverted mesas formed on said second side of the piezoelectric quartz wafer.

15. The method of fabricating a quartz resonator according to claim 14 wherein a plurality of electrodes are formed in a plurality of inverted mesas formed in the first side of the piezoelectric quartz wafer and a plurality of electrodes are formed in a plurality of inverted mesas formed in the second side of the piezoelectric quartz wafer, the inverted mesas in the first side of the piezoelectric quartz wafer opposing corresponding inverted mesas in the second side of the piezoelectric quartz wafer and the electrodes formed in inverted mesas in the first side of the piezoelectric quartz wafer opposing the corresponding electrodes formed in inverted mesas in the second side of the piezoelectric quartz wafer.

16. The method of fabricating a quartz resonator according to claim 12 further comprising etching one or more inverted mesas in the second side of the piezoelectric quartz wafer wherein the metal plug formed on said second side of the piezoelectric quartz wafer is disposed within one of said one or more inverted mesas formed on said second side of the piezoelectric quartz wafer.

17. The method of fabricating a quartz resonator according to claim 16 in which the inverted mesas are etched with a plasma etch.

18. The method of fabricating quartz resonators according to claim 12 further comprising thinning the piezoelectric quartz wafer to 2-50 microns in an active resonator region between opposing electrodes formed on said first and second sides of the piezoelectric quartz wafer.

19. The method of fabricating quartz resonators according to claim 12 wherein the piezoelectric quartz wafer is adhered to said substrate with the fluid ports therein using an inert polyimide-based tape or an epoxy adhesive.

20. The method of fabricating quartz resonators according to claim 12 wherein the one or more handle wafers is removed with a fluorine-based plasma etch and/or $XeF_2$.

21. A method of analyzing an analyte using a quartz resonator made in according with claim 12 wherein the electrode on the second side of the piezoelectric quartz wafer is grounded and the analyte is exposed to the grounded electrodes on the second side of the piezoelectric quartz wafer, thereby preventing electrical coupling of detector signals, obtained from the electrode on the first side of the piezoelectric quartz wafer, to the analyte.

22. The method of fabricating quartz resonators according to claim 12 wherein the electrode on the second side of the piezoelectric quartz wafer directly opposes the electrode on the first side of the piezoelectric quartz wafer.

* * * * *